US005790149A

United States Patent [19]

Abe et al.

[11] Patent Number: 5,790,149

[45] Date of Patent: Aug. 4, 1998

[54] INK JET RECORDING HEAD

[75] Inventors: Tomoaki Abe; Kazuo Koshino, both of Nagano, Japan

[73] Assignee: Seiko Epson Corporation, Tokyo, Japan

[21] Appl. No.: 565,622

[22] Filed: Nov. 29, 1995

Related U.S. Application Data

[63] Continuation-in-part of Ser. No. 335,816, filed as PCT/JP94/00871, May 31, 1994, published as WO94/29110, Dec. 22, 1994, abandoned.

[30] Foreign Application Priority Data

Jun. 3, 1993 [JP] Japan ..... 5-133631

[51] Int. Cl.[6] ..... B41J 2/145; B41J 2/15; B41J 2/05

[52] U.S. Cl. ..... 347/40; 347/65

[58] Field of Search ..... 347/40, 71, 107, 347/68, 94, 70, 54, 65

[56] References Cited

U.S. PATENT DOCUMENTS

| | | | |
|---|---|---|---|
| 4,312,010 | 1/1982 | Doring | 347/68 |
| 4,528,575 | 7/1985 | Matsuda et al. | 347/71 |
| 4,855,752 | 8/1989 | Bergstedt | 347/43 |
| 4,901,093 | 2/1990 | Ruggiero et al. | 347/70 |
| 5,087,930 | 2/1992 | Roy et al. | 347/71 |
| 5,475,279 | 12/1995 | Takeuchi et al. | 347/71 |

FOREIGN PATENT DOCUMENTS

| | | | |
|---|---|---|---|
| A10389016 | 9/1990 | European Pat. Off. | B41J 2/30 |
| A20430064 | 6/1991 | European Pat. Off. | B41J 2/51 |

OTHER PUBLICATIONS

Patent Abstracts of Japan; JP–A–04 312859 (Seiko Epson Corporation), Nov. 1992, *Abstract* Computer Technology Review, vol. VII, No. 13, 1987 Los Angeles US, pp. 104–107, McIntyre, "24–Wire Dot Matrix Printers Raise Quality of Print and Graphics", *p. 105, left column, paragraph 3; figure 1*.

Proceedings of The SID, vol. 25, No. 4, 1984 Playa Del Rey, CA US, pp. 311–314, Takada et al., "The Effect of Head Shape On DOD Ink–Jet Drop Formation", *p. 311; figure 2*.

*Primary Examiner*—N. Le
*Assistant Examiner*—Thinh Nguyen
*Attorney, Agent, or Firm*—Sughrue, Mion, Zinn, Macpeak & Seas, PLLC

[57] ABSTRACT

In an ink jet type recording head, nozzles 190 to 197 for jetting droplets of ink are arranged in such a manner that these nozzles are located along two line segments L1 and L2 which are inclined mutually in opposite directions with respect to a main scanning direction, and the two line segments constitute a substantially V-shape, so that problems such as a printing quality deterioration phenomenon and ink chamber interference can be solved, and higher printing qualities can be realized at high printing density.

14 Claims, 11 Drawing Sheets

INK JET RECORDING HEAD

This is a Continuation-in-Part of application Ser. No. 08/335,816, filed as PCT/JP94/00871 May 31, 1994 published as WO94/29110 Dec. 22, 1994, now abandoned.

BACKGROUND OF THE INVENTION

1. Field of the Invention

The present invention relates to an ink jet type recording head of an on-demand type for jetting ink droplets in response to a printing signal to form an ink image on a recording medium such as recording paper. More specifically, the present invention concerns an array of nozzles and a shape of an ink chamber for jetting a droplet of ink.

2. Background Art

Recently, there has been a need for ink jet type recording apparatuses capable of outputting an image recorded in high density. JP-A-60-147348 discloses such an ink jet type recording head capable of realizing higher recording density than the linear array density of the nozzles. In the ink jet type recording head described in this publication, the recording head having the linearly arranged nozzles along a single straight line is obliquely disposed with respect to the main scanning direction to increase the recording density. However, the structure of this recording head is problematic in that pitch fluctuation occurs in recording pixels, which is caused by dimensional errors or the like which occur when the recording head is mounted on the carriage. Accordingly, printing qualities are greatly influenced.

To the contrary, in accordance with the ink jet type recording head described in JP-A-4-312895, as shown in FIG. 12, the nozzles are arranged on a plurality of slanted straight lines in a zigzag form, and therefore, the printing quality can be improved regardless of accuracy in the mounting dimension.

To realize high density recording by the ink jet type recording head described in JP-A-4-312859, the pitch between respective nozzles must be narrowed, namely the angle $\alpha$ should be made small. However, this angle setting is essentially restricted in order to prevent an occurrence of crosstalk or the like, which is caused by interference among the ink chambers at the bending portions of the slanted straight lines. Also, since this recording head is constructed so as to have a plurality of bending portions, the permeative depths in ink are different from each other between the recorded image at the bending portions and the recorded image at the peripheral portions. Thus, as illustrated in FIG. 13, a plurality of fluctuations are produced in the entire recorded image.

As a consequence, it is an object of the present invention to provide an ink jet type recording head capable of realizing high recording density and high printing quality, and which is made highly integrated.

SUMMARY OF THE INVENTION

An ink jet type recording head according to the present invention is characterized in that nozzles for jetting ink droplets are arranged substantially along a V-shaped line which opens toward the main scanning direction of the recording head.

Also, the ink jet type recording head according to the present invention is characterized in that the nozzles are arranged substantially along combination lines of inclined line segments which are opened toward the main scanning direction, and such nozzles arranged along at least one inclined line segment are all shifted in the main scanning direction.

Further, the ink jet type recording head according to the present invention is characterized in that the nozzles are arranged substantially along combination lines of inclined line segments which are opened toward the main scanning direction, and some of the nozzles arranged along the inclined line segments are shifted in the main scanning direction.

Further, the ink jet type recording head according to the present invention is characterized in that its chambers communicated with respective nozzles are disposed perpendicular to the inclined line segments.

Further, the ink jet type recording head according to the present invention is characterized in that the ink chambers are disposed on both side of the inclined line segments.

DETAILED DESCRIPTION OF THE PREFERRED EMBODIMENTS

The present invention will now be described below in detail with reference to the accompanying drawings.

Figure 1:
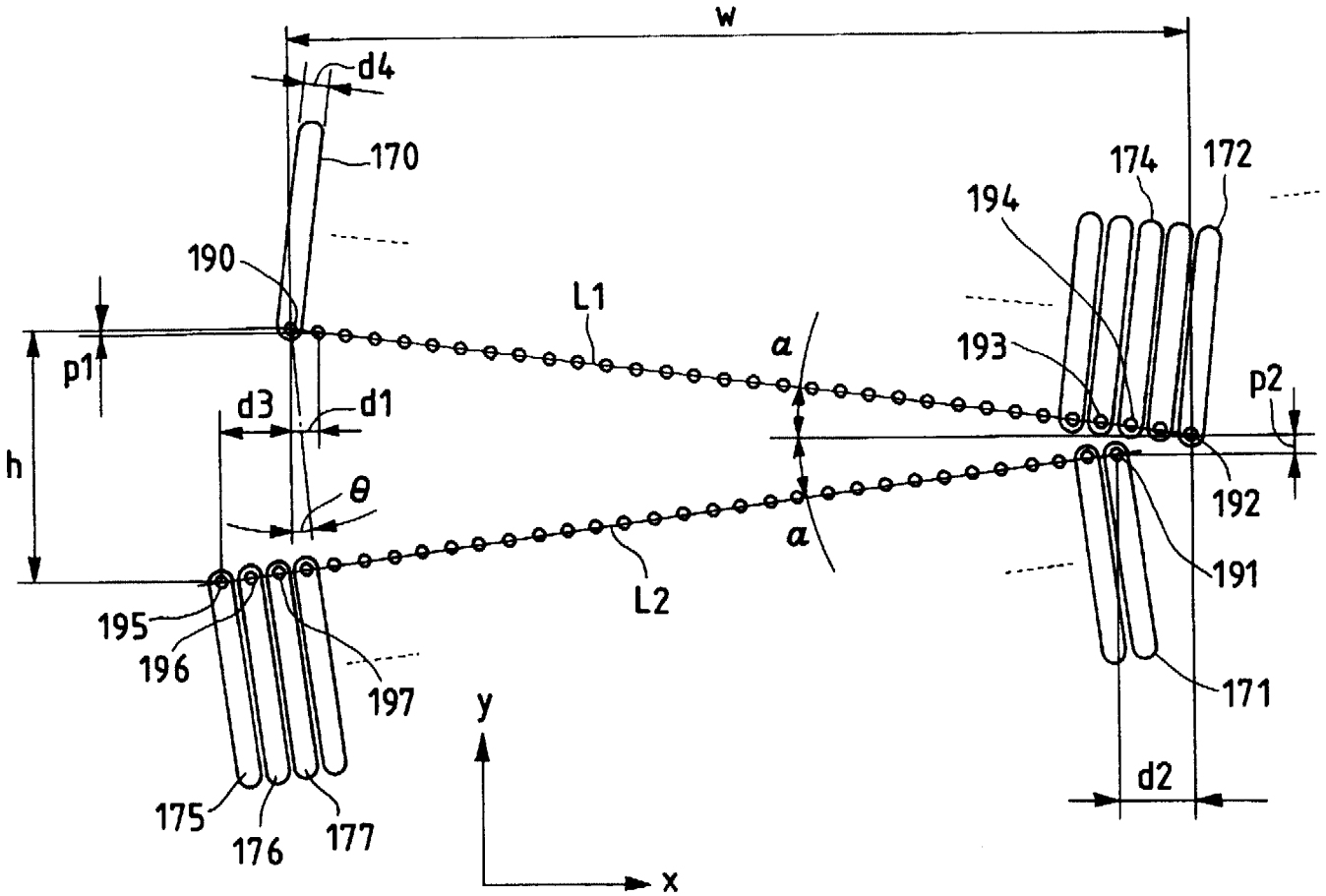
FIG. 1 is an explanatory diagram with respect to a nozzle arrangement and an ink chamber arrangement of an ink jet type recording head according to the present invention.

FIG. 1 is an explanatory diagram of a nozzle arrangement and an ink chamber arrangement of an ink jet type recording head according to an embodiment of the present invention.

In FIG. 1, the recording head according to this embodiment is provided with nozzles 190 to 197 for jetting a droplet of ink, and ink chambers 170 to 177 are communicated with these nozzles. Although partially omitted from this figure, the recording head is equipped with each ink chamber communicated with 32 nozzles along one line, i.e., 64 nozzles in total. In this figure, the nozzles are arranged at a constant interval in such a manner that these nozzles are positioned along line segments L1 and L2 corresponding to straight lines inclined in opposite directions with respect to the X direction, namely the main scanning direction (moving direction of the recording head mounted on a carriage). The line segments are each inclined at an angle of $\alpha$ in such a manner that the pitch P1 of each nozzle along the sub-scanning direction is 1/360th of an inch, and the line segment L1 and the line segment L2 together form a substantially V shape.

Figure 3:
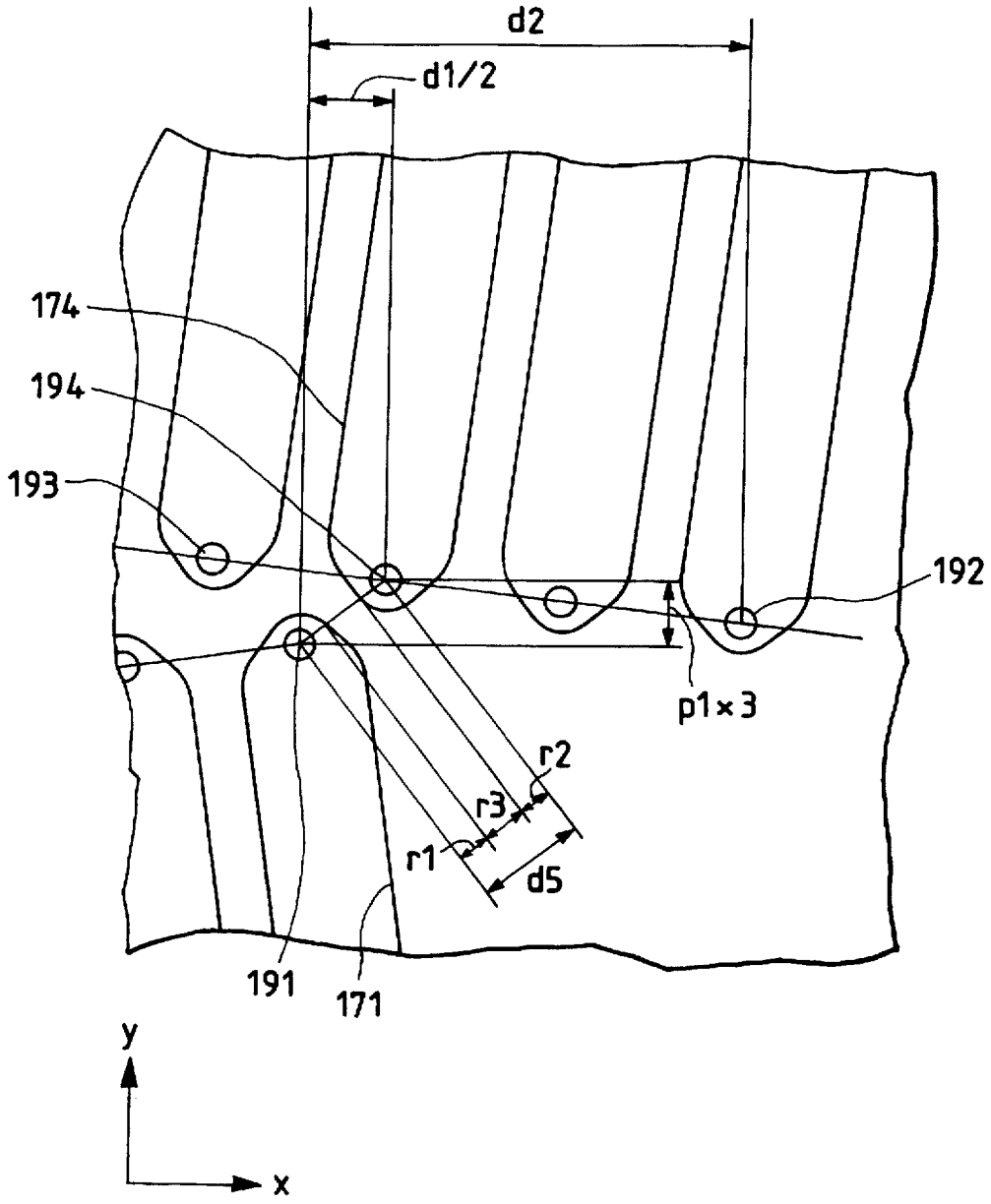
FIG. 3 is an enlarged diagram of a portion of the nozzles according to the first embodiment of the present invention.

As shown in FIG. 3, the ink chambers 170 are disposed perpendicular to the line segments L1 and L2. This makes it possible to maximize the width d4 of the ink chamber 170 which allows for the shortening of the length of the ink chambers, thus reducing the size of the recording head.

The ink chambers are arranged outside the V-shaped area formed by the line segments L1 and L2. A width "d4" of the respective ink chambers is wide enough to be able to obtain a sufficient ink jetting amount, i.e., 450 micrometers, and a depth thereof is deep enough to be able to secure sufficient ink flowability, i.e., 150 micrometers.

A pressure applying means is used for applying pressure to the ink chambers constructed in the above-described manner. As one example, a pressure applying means may be employed in which a piezoelectric element is laminated to a vibrating plate that constitutes the wall of the ink chamber, or a piezoelectric element is printed on a vibrating plate and the resultant object is sintered.

The dimensions of the overall nozzle according to this embodiment are, for example, w=d1×24=13.55 mm, and h=p1×47=3.32 mm.

Figure 2:
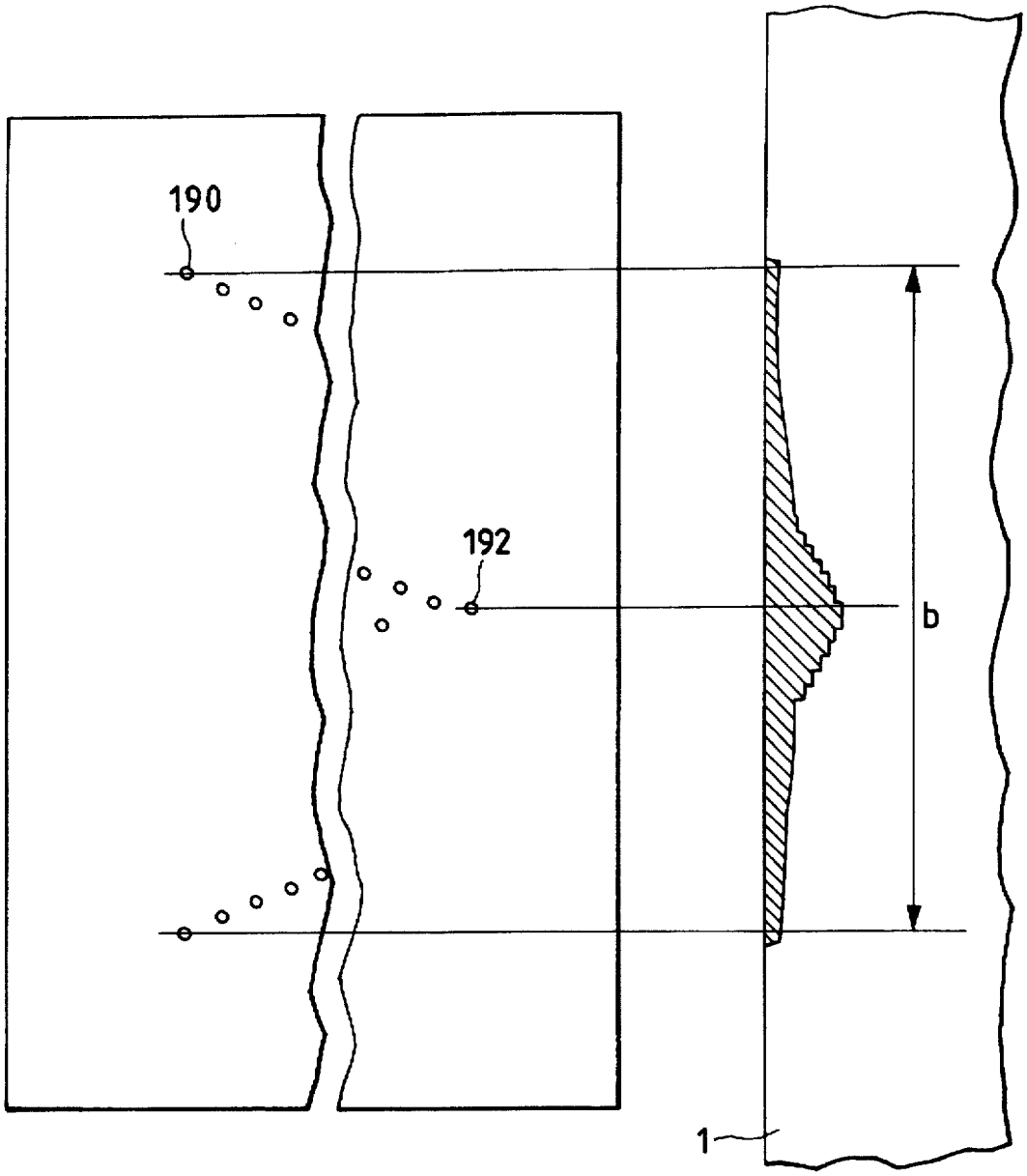
FIG. 2 schematically shows a printing condition of a first embodiment of the present invention.

In accordance with the recording head of the present invention, since the nozzles are arranged in a V shape, the problems of the conventional recording head as described in JP-A-4-312859 are eliminated. For example, in the conventional recording head, dark/light ink fluctuation occurs in various places. By way of contrast, in accordance with the recording head of the present invention, as shown in FIG. 2, the printing density is high only in the area near the nozzle 192 at the central portion, and printing density around the edge nozzle 190 is uniform, so that the printing density fluctuation is suppressed or minimized over the entire printing width "b". Accordingly, even when a graphic image is recorded using the recording head of this embodiment, it is possible to print a high quality image without deteriorating texture.

In this embodiment, as shown in FIG. 1, the nozzles along the inclined line segment L2 (namely, nozzles 191, 195, 196 and 197 are positionally shifted with respect to the position of the nozzle 192 in the main scanning direction (namely, the X direction as shown in this drawing) by a shift amount of d2=d1×2.5=p1×20. Furthermore, a distance "P2" between the nozzle 192 and the nozzle 191 in the sub-scanning direction, located at the edge portions of the line segment L1 and the line segment L2, is made equal to P1, i.e., they have the same pitch. The pitch between the nozzle 194 and the nozzle 191 was selected to be P1×3. FIG. 3 is a partial enlarged diagram showing how the nozzles are positionally shifted. As illustrated in the drawing, in accordance with this embodiment, the nozzle array along the line segment L2 is positionally shifted from the nozzle array along the line segment L1 by an amount of 2.5 times as large as one nozzle pitch along the "X" direction. Further, the nozzle 191 along the line segment L2 is arranged at a position of d1/2 between the nozzle 193 and the nozzle 194 along the line segment L1. Since, as described above, these nozzles are positionally shifted by the shift amount of d2=d1×2.5=P1×20, the minimum distance between the nozzles 191 and 194 which are mutually positioned at the nearest place from each other can be made relatively large, while maintaining sufficiently high printing density. Also, sufficient rigidness of the wall between the ink chamber 171 and the ink chamber 174 can be achieved. As a consequence, it is possible to eliminate cross talk.

Since the shift amount "d2" is set to be an integer times as large as the printing pitch P1 such as d2=d12×0.5=P1×20, the printing timing of the nozzles (namely, nozzles 191, 195, 196 and 197 shifted in the main scanning direction can be correctly determined by counting the reference timing (interval of reference timing corresponds to pitch p1 in this embodiment) along the main scanning direction by an integer (for instance, nozzle 191 is shifted from nozzle 192 by 20 reference timings). The reference timing along the main scanning direction may be directly obtained from either outputs of linear encoders arranged along the same direction, or pulse numbers of a stepping motor for driving the recording head. In accordance with this embodiment, the pixels can be formed accurately by the nozzle groups which are shifted along the main scanning direction without additionally employing a specific timing generating mechanism, so that higher printing qualities can be achieved.

Moreover, in accordance with this embodiment, the shape of the ink chamber positioned near the nozzle is made not by a curved surface with a constant radius, but by a curved surface having a smaller radius at the portion nearer to the nozzle, so that the distance between the nozzles located adjacent to each other is increased. Thus, interference such as crosstalk is more surely avoided, and better bubble exhausting characteristics are achieved since the radius of the curved surface is progressively decreased approaching the end of the nozzle.

In this embodiment, the minimum distance (d5=352.8 micrometers) between nozzles 191 and 194 is larger than a total value (d6=r1+r2=200 micrometers) of a distance (r1=100 micrometers) between the center of the nozzle 191 and an outer periphery of the ink chamber 171, and also a distance (r2=100 micrometers) between the center of the nozzle 194 and an outer periphery of the ink chamber 174, so that r3 can be made wide, i.e., larger than 100 micrometers, and so that the wall between the ink chambers can be made rigid.

In accordance with the recording head of the present invention, there is substantially no risk that printing qualities are deteriorated by mounting errors and the like. The reason is described in detail below.

Figure 4:
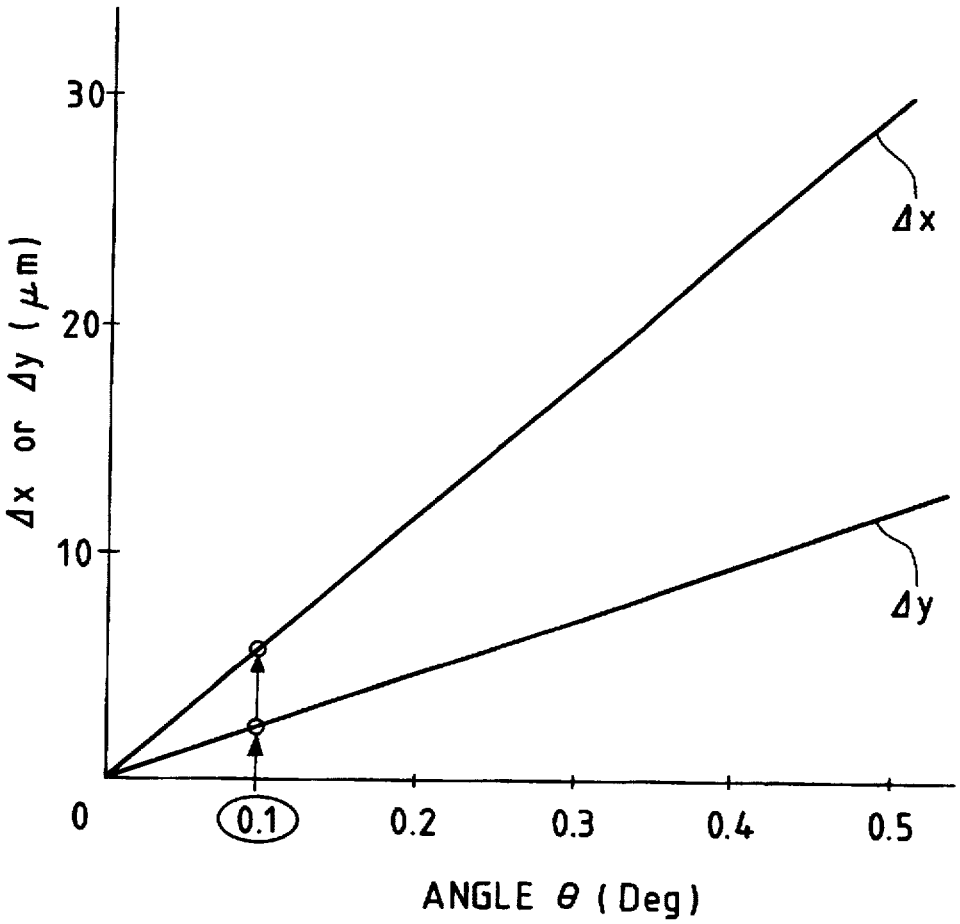
FIG. 4 is a graph showing positional shifts in pixels according to the first embodiment of the present invention.

Since the printing pitch P1 is selected to the 1/360 inches (=70.6 micrometers) in this embodiment, the diameter of a single pixel on the recording medium 1 is preferably on the order of 100 to 120 micrometers, such that the recording medium is completely covered. As to such a pixel dimension, positional shifts of 20 to 30 micrometers in the pixels can be visually recognized, resulting in deterioration of printing qualities. In accordance with this embodiment, the positional shift of the nozzle 195 by the angle $\theta$ is expressed as $\Delta x=h\times\pi\times\theta/180$ along the X direction and $\Delta y = d3 \times \pi \times \theta / 180$ ($h = P1 \times 47 = 3.32$ mm, $d3 = d1 \times 2.5 = 1.41$ mm). The actual positional shift with respect to the angle $\theta$ is represented in FIG. 4. Generally speaking, the angle $\theta$ is on the order of 0.1 degrees involving play of various components and part precision or the like, and the positional shifts are therefore small such as $\Delta x = 6$ micrometers and $\Delta y = 2.5$ micrometers. Thus, it is possible to apply this angle while maintaining sufficient printing qualities.

The recording head of the present invention can be readily mounted on an ink jet type recording apparatus of the type in which the recording head is easily replaced by the user and without paying too much attention to the mounting accuracy of the carriage since positional shifts do not significantly affect the printing quality.

Figure 5:
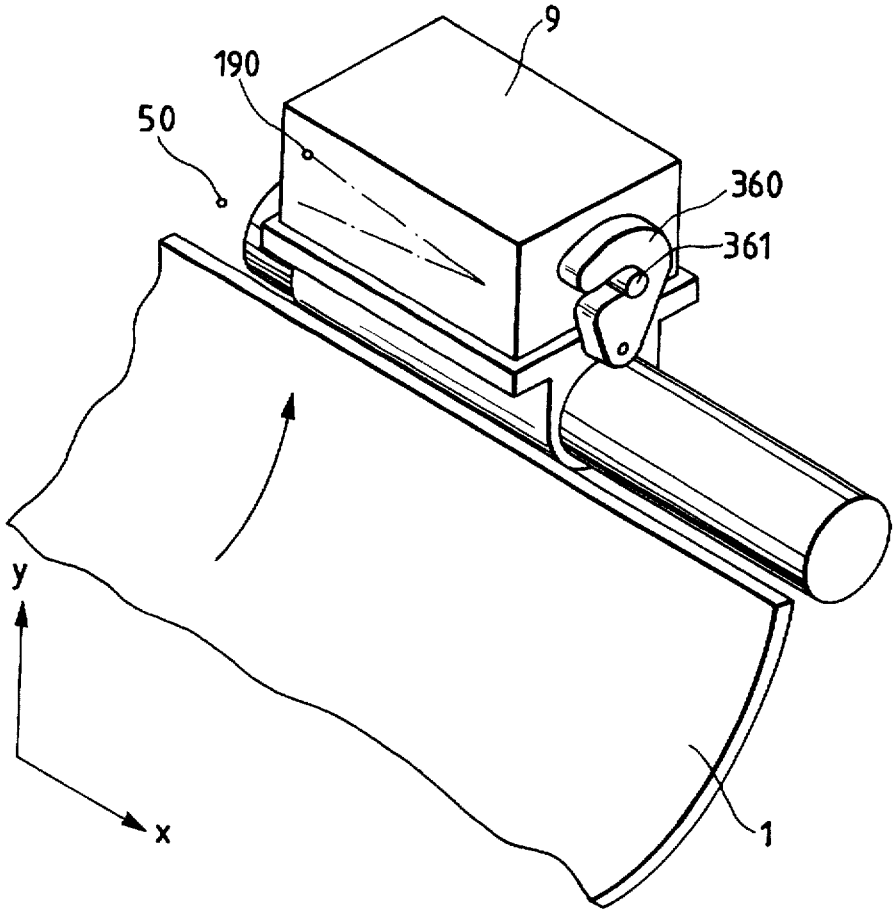
FIG. 5 is a perspective view for explaining a mounting condition of the ink jet type recording head according to the present invention.
Figure 6:
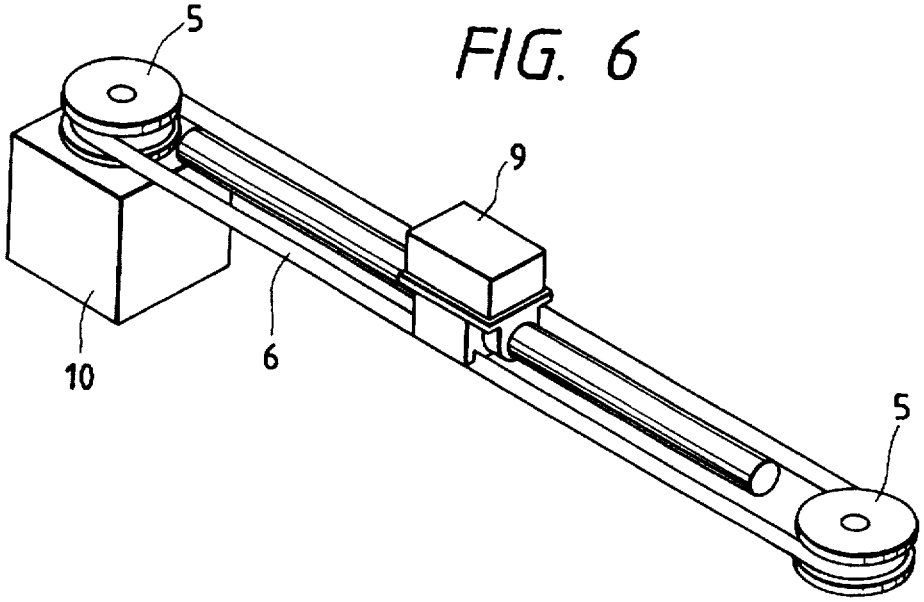
FIG. 6 is a perspective view showing a transporting mechanism of the ink jet type recording head according to the present invention.
Figure 7:
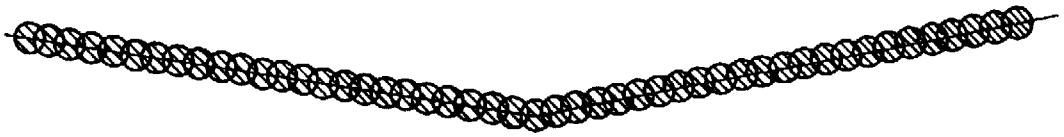
FIG. 7 schematically shows a printing pattern of the first embodiment of the present invention.

The recording head may be easily mounted even on a recording apparatus having a simple supporting mechanism with an arm 360 and a pin 361 as shown in FIG. 5. In this recording apparatus, the recording head 9 is moved along the main scanning direction (x-direction in this figure) relative to the recording medium while droplets of ink 50 are jetted from the nozzle 190, thereby forming pixels on the recording medium 1. After the above-described pixel formation along the main scanning direction has been accomplished, the recording medium 1 is transported along the sub-scanning direction (y-direction in this figure) perpendicular to the main scanning direction. Subsequently, the recording operation is continued by performing a process wherein the pixels are formed on an empty portion of the recording medium 1 along the main scanning direction (x-direction in this figure). The movement of the recording head is performed by driving a belt 6 via a pulley 5 by a stepping motor 10, as illustrated in FIG. 6. Even when errors are produced in a feeding amount along the main scanning direction due to eccentricity of the pulley 5, or vibrations or expansion and contraction of the belt 6 caused by external conditions, smooth and continuous patterns are printed out as shown in FIG. 7 by employing the recording head of this embodiment. Therefore, the recording head of this embodiment is advantageous in that any disturbances in the vertical lines are so small that they cannot be visually observed, thereby providing high quality printing.

Figure 8:
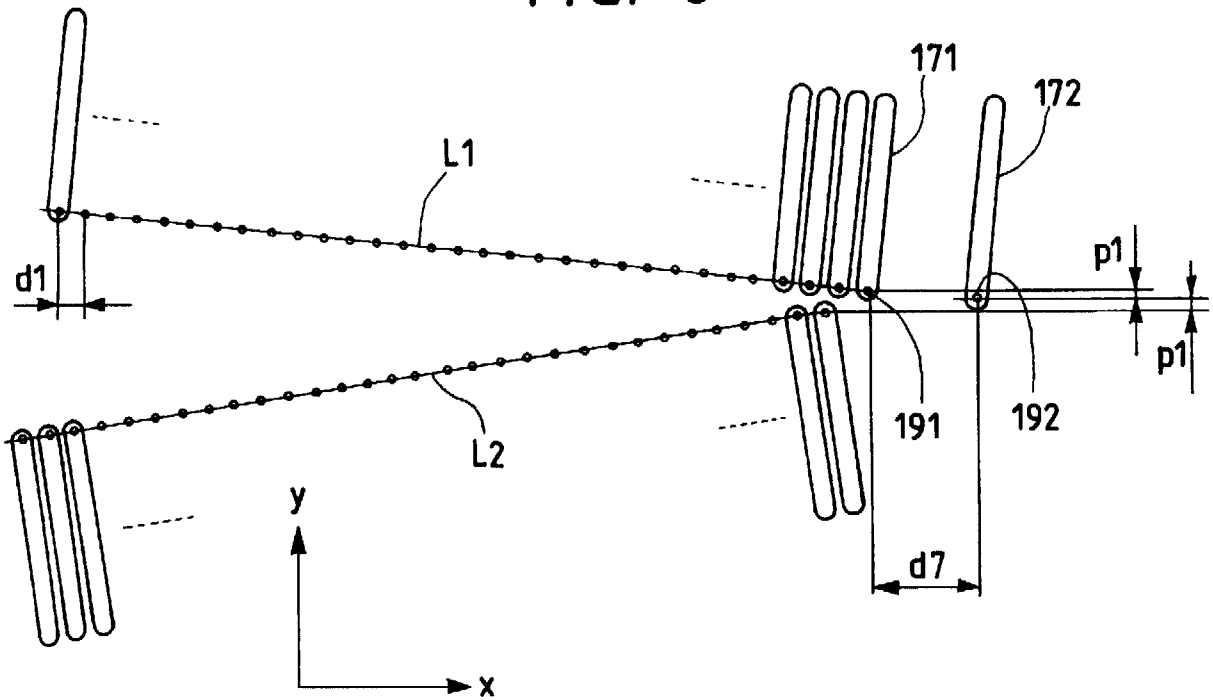
FIG. 8 schematically shows an ink jet type recording head according to another embodiment of the present invention.

FIG. 8 shows another embodiment of the present invention. This embodiment is characterized in that some of the nozzles (a nozzle 192 in this figure) positioned along the inclined line L1 are positionally shifted along the main scanning direction (x-direction in this figure). In this manner, the nozzle 192 is shifted by a relatively large amount ($d7 = d1 \times 3$) relative to the nozzle 191. Thus, a droplet of ink is jetted from the nozzle 192 at an early stage onto the recording medium and then is dried, thereby forming pixels at the early stage. Accordingly, even when the ink droplets jetted from the next nozzle 191 are overlapped on the image formed by the ink droplets jetted from the nozzle 192, since the image formed by the nozzle 192 has dried, the ink droplets are not partially collected, and fluctuation of ink density at the central printed portion is further suppressed. While only the nozzle 192 is positionally shifted in this embodiment, the effect as to the ink density fluctuation may be further improved when a plurality of nozzles are positionally shifted in this manner.

Figure 9:
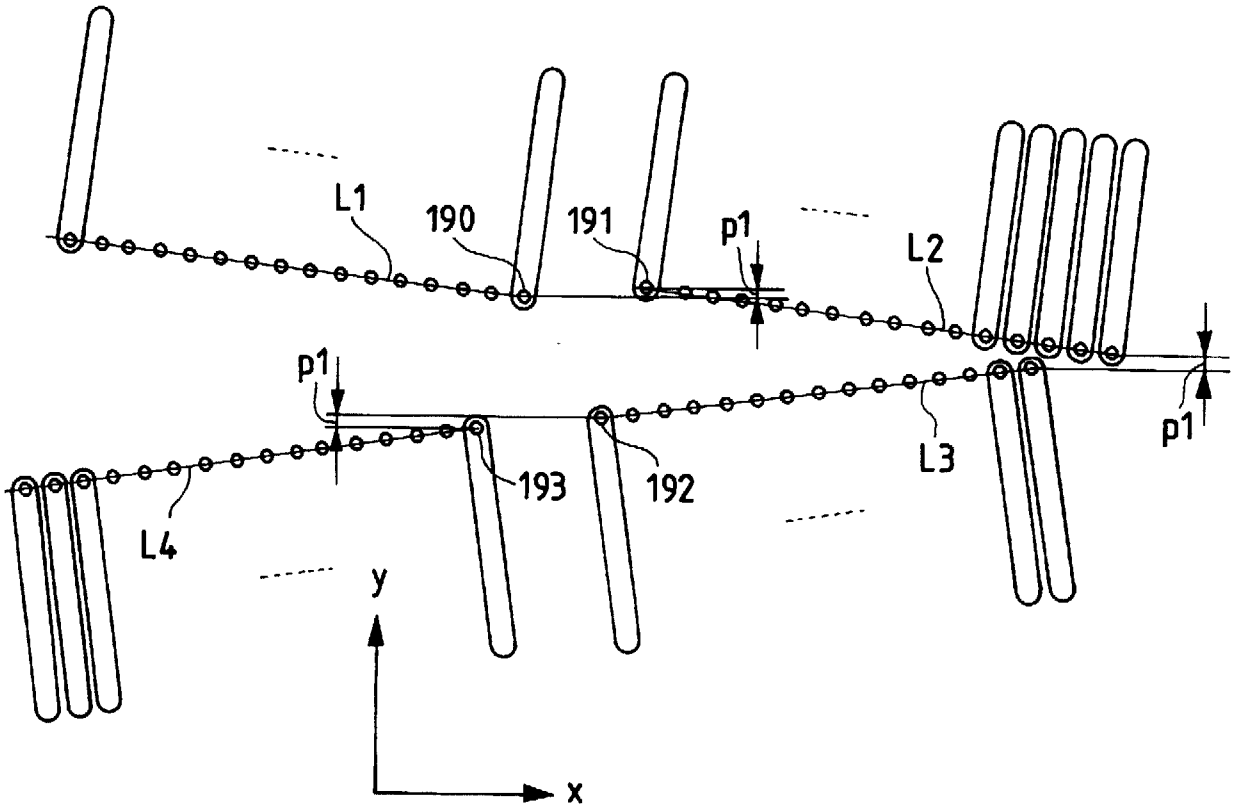
FIG. 9 schematically represents an ink jet type recording head according to still another embodiment of the present invention.

FIG. 9 shows a further embodiment of the present invention. In this embodiment, the nozzles are arranged along a plurality of line segments L1, L2, L3 and L4. As an example, different colors are allocated to the respective line segments in such a manner, for example, that a black color is allocated to the line segment L1, a cyan color is allocated to the line segment L2, a magenta color is allocated to the line segment L3, and a yellow color is allocated to the line segment L4. The line segments L1 and L4 are separated from the line segments L2 and L3 along the main scanning direction (x-direction), respectively, so that a distance between the nozzles 190 and 191 is relatively large, and so that the distance between the nozzles 192 and 193 is relatively large. Accordingly, the different colors flowing from the nozzles 190, 191, 192 and 193 are not moved and, therefore, do not produce muddy colors.

Figure 10:
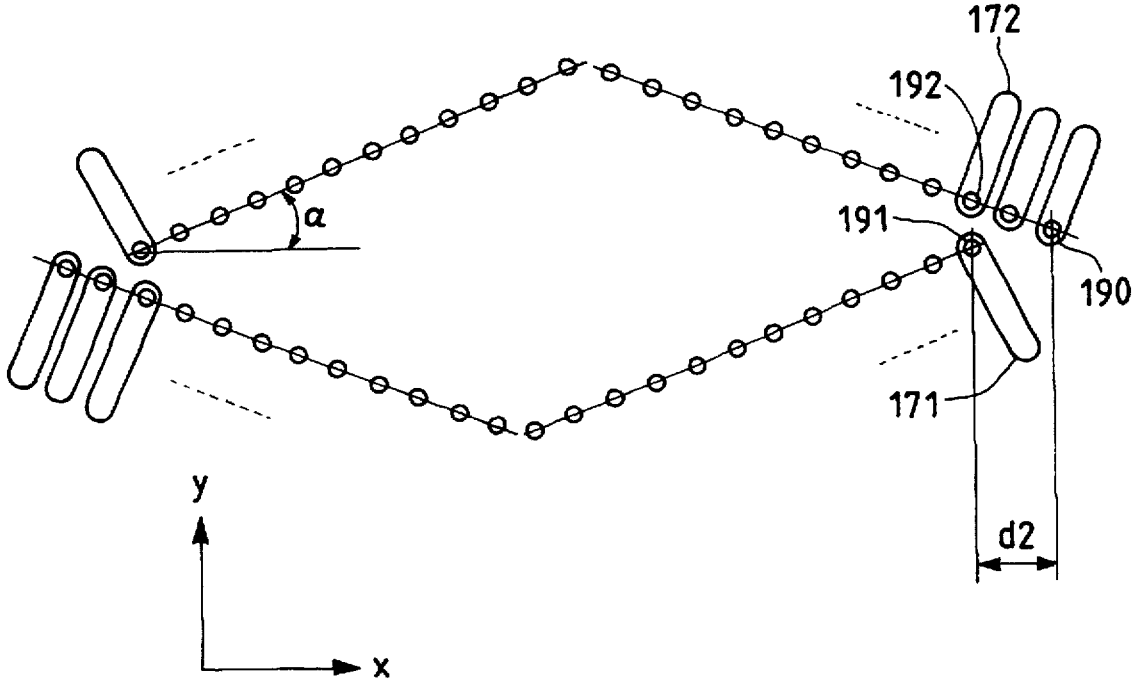
FIG. 10 schematically shows an ink jet type recording head according to yet another embodiment of the present invention.

FIG. 10 shows a further embodiment of the present invention. This recording head is formed in a lozenge shape by combining two sets of V-shaped nozzle arrangements. In accordance with this nozzle arrangement, after the thinning printing operation has been carried out by one of the V-shaped nozzle arrangements along the main scanning direction during the recording operation, the printing operation by the other V-shaped nozzle arrangement is carried out in order to fill the gaps between the printed pixels by the thinning printing operation. It is thus possible to solve problems such as ink blurring.

Figure 11:
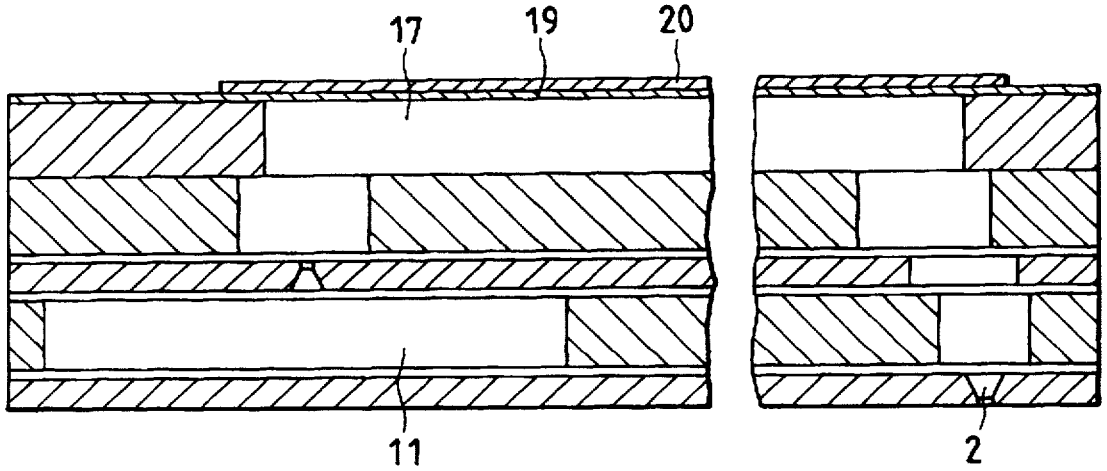
FIG. 11 is an explanatory diagram of the ink jet type recording head according to the present invention.
Figure 12:
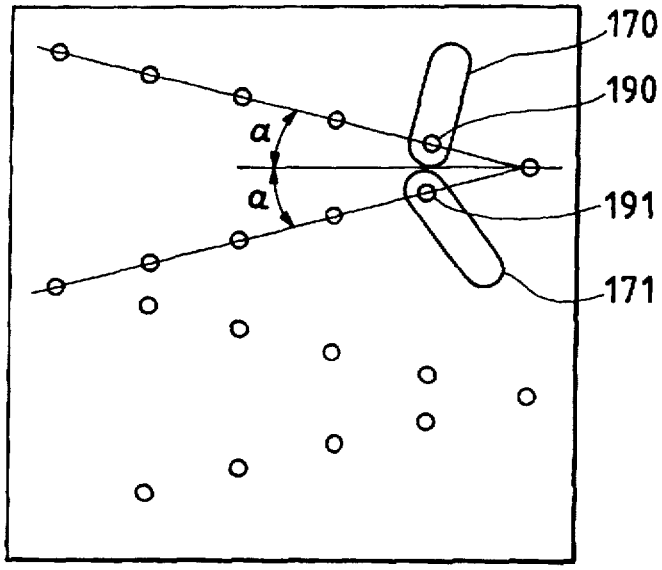
FIG. 12 is an explanatory diagram of the conventional nozzle arrangement and the conventional ink chamber arrangement.
Figure 13:
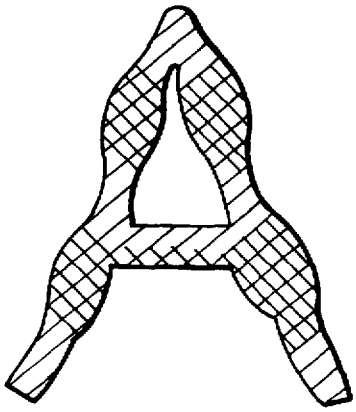
FIG. 13 is an explanatory diagram of the conventional printing condition.

One preferable example of the structure of an ink jet type recording head according to the present invention is shown in FIG. 11. This is known as a stacked type ink jet type recording head. In this recording head, stacked flow path ports in the flow path from an ink chamber 17 to a nozzle 2 can be gradually shifted with ease. As a result, since the position of the nozzle 2 may be shifted outside the ink chamber rather than at the edge portion of the ink chamber 17, the location of the ink chamber can be lowered as compared with that of the nozzle. When this structure is employed in the V-shaped nozzle arrangement of the present invention, the distances between the adjacent ink chambers can be made sufficiently large. Thus, crosstalk is sufficiently prevented, and the distances between the nozzles can be shortened. It is therefore possible to arrange the nozzles at a high density. In FIG. 11, the ink is supplied from a common ink chamber 11 to the ink chamber 17, and then is jetted from the nozzle 2 via the flow path by pressuring vibrating plates 19 stacked on the ink chamber 17 by way of a piezoelectric element 20.

Figure 14:
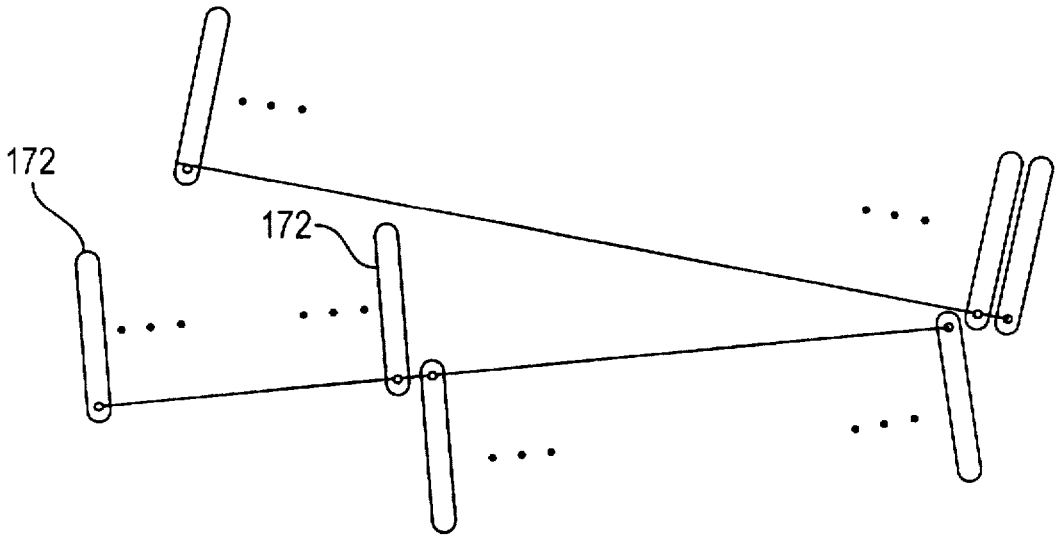
FIG. 14 shows an ink jet type recording head according to yet another embodiment of the present invention.
Figure 15:
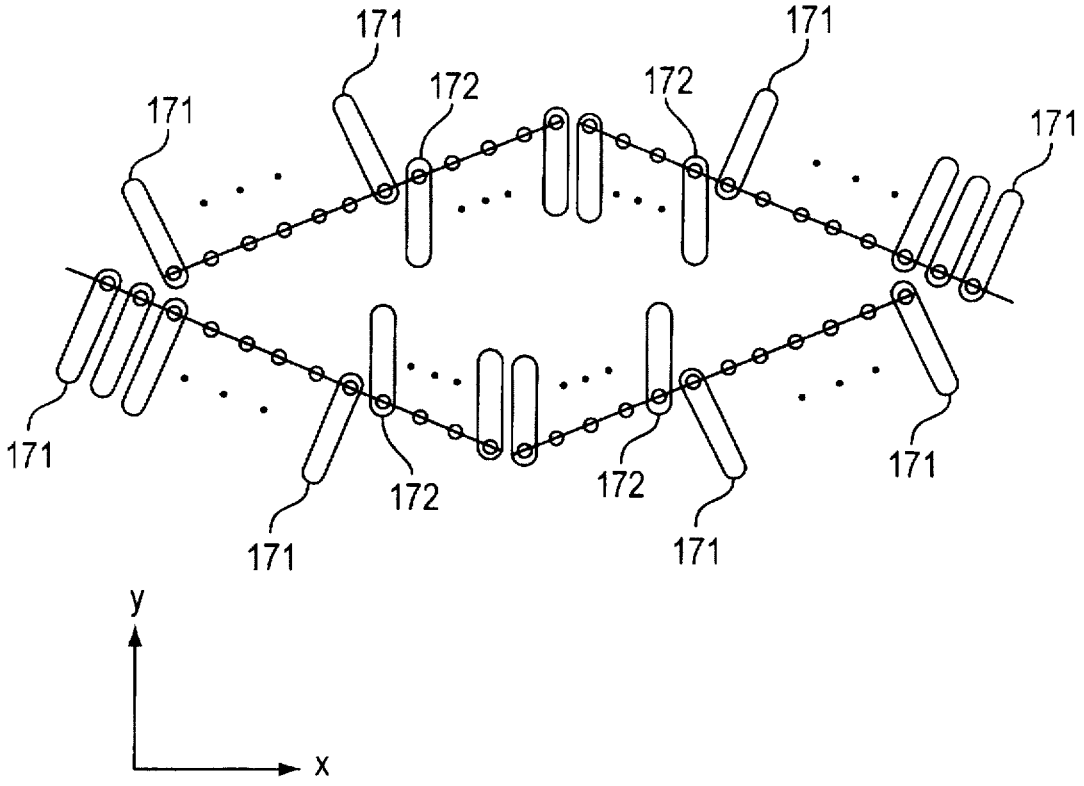
FIG. 15 shows an ink jet type recording head according to yet another embodiment of the present invention.

The embodiment as shown in FIGS. 14 and 15 include ink chambers 172 disposed on the inside of a V-shaped nozzle arrangement and on the inside of a lozenge shaped nozzle arrangement, respectively. These two arrangements are advantageous in that positions of the ink chambers protruding outside of the nozzle arrangement can be minimized, thus resulting in a recording head of reduced size.

As described above, in accordance with the present invention, it is possible to provide a highly integrated ink jet type recording head capable of printing an image at high recording density, and of suppressing printing fluctuation, while printing qualities are not adversely influenced by mounting errors.

As described above, the ink jet type recording head of the present invention can be used, for example, in such recording apparatuses as printers, facsimiles, and copying machines.

We claim:

1. An ink jet type recording head comprising a plurality of nozzles for jetting ink droplets and being moveable in a transport direction, wherein said plurality of nozzles include a first group of nozzles arranged in a first straight line and a second group of nozzles arranged in a second straight line with the nozzles in each said first and second straight line being spaced at a predetermined interval from each other, said first straight line and said second straight line being inclined in opposite directions with respect to a main scanning direction corresponding to said transport direction of the recording head to form a substantially V-shaped nozzle array, said first straight line and said second straight line being substantially symmetrical about an axis parallel to said scanning direction, and wherein said first group of nozzles is positionally shifted by a predetermined distance in the main scanning direction with respect to said second group of nozzles.

2. The ink jet type recording head as recited in claim 1, wherein each of the nozzles of said first group of nozzles is arranged between two corresponding nozzles of said second group of nozzles so as to be arranged in an interdigitated manner.

3. The ink jet type recording head as recited in claim 1, wherein the predetermined distance is about 2.5 times greater than the predetermined interval between each of the plurality of nozzles.

4. An ink jet type recording head comprising a plurality of nozzles for jetting ink droplets and being moveable in a transport direction, wherein said plurality of nozzles include a first group of nozzles arranged in a first straight line and a second group of nozzles arranged in a second straight line with the nozzles in each said first and said second straight line being spaced a predetermined interval from each other, said first straight line and said second straight line being inclined in opposite directions with respect to a main scanning direction corresponding to said transport direction of the recording head to form a substantially V-shaped nozzle array having a tip at which said first and second straight lines intersect wherein said first group of nozzles includes an additional nozzle separated from an adjacent nozzle by a distance greater than the predetermined interval, said additional nozzle being at an end of said first group of nozzles which forms a tip of said V-shaped array.

5. The ink jet type recording head as recited in claim 1, further comprising a plurality of ink chambers each communicated with a respective one of said nozzles and having a multistepped curved surface near said nozzles such that a diameter of the curved surface is made progressively smaller approaching said nozzles.

6. The ink jet type recording head as recited in claim 1 comprising two nozzle arrays arranged end to end in a lozenge shape.

7. The ink jet type recording head as recited in claim 1, wherein the ink jet type recording head is a stacked type head having a plurality of ink chambers, and wherein positions between the ink chambers and said nozzles are variable.

8. The ink jet type recording head as recited in claim 1, further comprising a plurality of the substantially V-shaped nozzle arrays arranged end to end in ever widening fashion with a gap between adjacent distal ends of the V-shaped nozzle arrays.

9. The ink jet type recording head as recited in claim 1, further comprising a plurality of ink chambers, wherein each of said ink chambers is in communication with a respective one of said nozzles, and is perpendicular to the straight line in which said one of said nozzles is arranged.

10. The ink jet type recording head as recited in claim 1, further comprising a plurality of ink chambers in communication with a respective one of said nozzles, wherein at least one of said ink chambers is disposed on an inside of said V-shape nozzle array.

11. The ink jet type recording head as recited in claim 6, further comprising a plurality of ink chambers in communication with a respective one of said nozzles, wherein at least one of said ink chambers is disposed on an inside of said lozenge shape.

12. An ink jet type recording head comprising:

a plurality of nozzles for jetting ink droplets and being moveable in a transport direction, wherein said plurality of nozzles include a first group of nozzles arranged in a first straight line and a second group of nozzles arranged in a second straight line with the nozzles in each said first and said second straight line being spaced at a predetermined interval from each other, said first straight line and said second straight line being inclined in opposite directions with respect to a main scanning direction corresponding to said transport direction of the recording head to form a substantially V-shaped nozzle array; and a plurality of ink chambers each communicated with a respective one of said nozzles and having a cross-section taken parallel to said V-shaped nozzle array with a multistepped curved shape near said nozzles such that a diameter of the curved shape is made progressively smaller approaching said nozzles.

13. An ink jet type recording head comprising a plurality of nozzles for jetting ink droplets and being moveable in a transport direction, wherein said plurality of nozzles include a first group of nozzles arranged in a first straight line and a second group of nozzles arranged in a second straight line with the nozzles in each said first and said second straight line being spaced at a predetermined interval from each other, said first straight line and said second straight line being inclined in opposite directions with respect to a main scanning direction corresponding to said transport direction of the recording head to form a substantially V-shaped nozzle array, said first straight line and said second straight line being substantially symmetrical about an axis parallel to said scanning direction, said first group of nozzles being positionally shifted by a predetermined distance in the main scanning direction with respect to said second group of nozzles, and wherein said recording head further comprises a plurality of the substantially V-shaped nozzle arrays arranged end to end in ever widening fashion to form a diamond-shaped array with a gap between adjacent distal ends of the V-shaped nozzle arrays.

14. The ink jet type recording head as recited in claim 12, wherein said first straight line and said second straight line are substantially symmetrical about an axis parallel to said scanning direction.

* * * * *